US005806900A

United States Patent [19]

Bratcher et al.

[11] Patent Number: 5,806,900

[45] Date of Patent: Sep. 15, 1998

[54] STOP FOR A SLIDABLE WINDOW

[75] Inventors: Michael P. Bratcher, Munster, Ind.; James G. Prete, Hinsdale, Ill.

[73] Assignee: Ashland Products, Inc., Lowell, Ind.

[21] Appl. No.: 740,978

[22] Filed: Nov. 5, 1996

[51] Int. Cl.[6] ..... E05C 1/02

[52] U.S. Cl. ..... 292/137; 292/175; 292/153; 292/DIG. 47

[58] Field of Search ..... 292/175, 153, 292/DIG. 46, DIG. 47, DIG. 15; 49/161, 175

[56] References Cited

U.S. PATENT DOCUMENTS

| | | | |
|---|---|---|---|
| 16,228 | 12/1856 | Copeland | 292/153 X |
| 163,008 | 5/1875 | Gillespie et al. . | |
| 190,074 | 4/1877 | Penfield | 292/175 |
| 357,116 | 2/1887 | Coultaus | 292/153 X |
| 416,681 | 12/1889 | Krom | 292/175 |
| 534,185 | 2/1895 | Winchester . | |
| 666,596 | 1/1901 | Breen . | |
| 756,453 | 4/1904 | Arens et al. | 292/153 X |
| 976,777 | 11/1910 | Brown . | |
| 1,261,274 | 4/1918 | Newsam . | |
| 1,388,272 | 8/1921 | Lawrence . | |
| 1,866,233 | 7/1932 | Tarrant | 292/175 X |
| 1,895,146 | 1/1933 | Brown . | |
| 1,940,084 | 12/1933 | Grasso | 292/175 X |
| 2,249,132 | 7/1941 | Haslam . | |
| 2,850,312 | 9/1958 | Rifkin . | |
| 2,950,136 | 8/1960 | Pengelly . | |
| 3,021,163 | 2/1962 | Hoffmann . | |
| 3,330,585 | 7/1967 | Pollin | 292/175 X |
| 4,110,867 | 9/1978 | Gwozdz | 292/228 X |
| 4,303,266 | 12/1981 | Volpi . | |
| 4,400,026 | 8/1983 | Brown, Jr. . | |
| 4,462,623 | 7/1984 | Grant | 292/175 |
| 4,553,353 | 11/1985 | Simpson . | |
| 4,578,903 | 4/1986 | Simpson . | |
| 4,797,970 | 1/1989 | Charlton . | |
| 4,824,154 | 4/1989 | Simpson . | |
| 4,917,416 | 4/1990 | Westphal et al. | 292/175 |
| 4,923,230 | 5/1990 | Simpson . | |
| 4,932,694 | 6/1990 | Cater, Sr. . | |
| 5,018,241 | 5/1991 | Baines . | |
| 5,096,240 | 3/1992 | Schultz . | |
| 5,165,737 | 11/1992 | Riegelman . | |
| 5,248,174 | 9/1993 | Matz et al. . | |
| 5,553,903 | 9/1996 | Prete et al. . | |

FOREIGN PATENT DOCUMENTS

| | | | |
|---|---|---|---|
| 1316965 | 4/1993 | Canada . | |
| 1584058 | 10/1966 | Germany | 292/DIG. 15 |
| 2056540 | 3/1981 | United Kingdom | 292/DIG. 46 |

*Primary Examiner*—Rodney M. Lindsey
*Attorney, Agent, or Firm*—Wallenstein & Wagner, Ltd.

[57] ABSTRACT

A window stop (10) for limiting movement of a sliding window along a predetermined path of window movement is provided. The window stop (10) has a housing (12) having a cavity (20) wherein the housing (12) is adapted to be positioned adjacent the path of window movement. A bolt (14), operatively associated with the cavity (20), is moveable between a first position (BP1) within the housing (12) and thereby out of the path of window movement, and a second position (BP2) extending out of the housing (12) into the path of the window movement whereby the window is able to contact the bolt (14). An actuator (16) is pivotally supported by the bolt (14) between a first position (AP1) locking the bolt (14) within the housing (12) and a second position (AP2) allowing the bolt (14) to extend to its second position (BP2). A spring (58) biases the bolt toward its second position. The bolt (14) receives forces from the window contacting the extended bolt (14). A tongue and groove arrangement is provided to allow efficient distribution of forces from the bolt (14) to the housing (12).

27 Claims, 5 Drawing Sheets

STOP FOR A SLIDABLE WINDOW

DESCRIPTION

TECHNICAL FIELD

This invention relates generally to a device for selectively limiting the movement of a sliding member and more particularly concerns a window stop for selectively limiting the movement of a window that slides either horizontally or vertically along a track.

BACKGROUND

Sliding window assemblies often include a pair of window sashes. One assembly is commonly referred to as a double-hung sash window. A double-hung window typically includes a window frame and a pair of window sashes mounted for vertical sliding movement, one relative to the other, within the window frame. Another window assembly may generally be referred to as a horizontal sliding window. A horizontal sliding window also includes a window frame and pair of window sashes mounted for lateral sliding movement, one relative to the other, within the window frame. Although window assemblies traditionally have been made exclusively of wood, window assemblies are increasingly being formed of extruded plastic or metal frame members which are joined at mitered corners, to form a generally rectangular frame in which glazing is mounted. Examples of these types of window assemblies are shown in FIGS. 1 and 2.

In these window assemblies, it is important to be able to selectively limit the distance the sliding window sash may travel. For example, a window sash may be partially opened, enough to allow for venting, while still inhibiting egress in or out through the window.

To selectively limit the movement of the sliding window sash, window stops have been developed. One type of window stop is shown in U.S. Pat. Nos. 4,824,154; 4,923,230 and 5,248,174, having the same assignee as the present invention. This window stop is a compact unit typically mounted in a stile of a window frame (See FIG. 1). The window stop generally includes a tumbler within a housing. The tumbler rotates out of the housing and extends into the path of a sliding window sash thus limiting movement of the sash. While this window stop has been very effective in this application, the amount of force that the tumbler can absorb is limited. In some applications, too much force can be delivered from the sliding window. The high impact of the sliding window against the stop causes the tumbler to overrotate, sometimes breaking the window stop.

A second type of window stop is shown in U.S. Pat. No. 5,553,903, having the same assignee as the present invention. This window stop can be mounted in a track of a sliding window (See FIG. 2) and can also be mounted in a stile of a window frame like the stop shown in FIG. 1. This window stop generally includes a bolt and latch within a housing. By operating the latch, the bolt extends directly out of the housing into the path of a sliding window sash, thus limiting movement of the sash. The bolt does not rotate out of the housing. This second window stop has guides between the housing and bolt that increases the resistive areas over which forces may be transferred. Consequently, this window stop can absorb greater forces than the window stop having the rotating tumbler. This window stop has also been very effective in this application. Because the window stop housing has separate cavities to accommodate the latch and bolt, however, the stop is not as compact in size. In addition, the second window stop is more costly than the window stop having the rotating tumbler.

The present invention is provided to solve these and other problems.

SUMMARY OF THE INVENTION

The present invention relates to a window stop for limiting movement of a sliding window along a predetermined path of window movement. Besides for sliding windows, however, the invention could also be used to limit movement of a number of different sliding members. According to a first aspect of the invention, the window stop has a housing having a cavity. The housing is adapted to be positioned adjacent the path of window movement. A bolt is operatively associated with the cavity and moveable between a first position within the housing and thereby out of the path of window movement, and a second position extending out of the housing into the path of the window movement whereby the window is able to contact the bolt. An actuator is operatively associated with the cavity and movable between a first position locking the bolt within the housing and a second position allowing the bolt to extend to its second position. A spring biases the bolt towards its second position. A means is provided for pivotally coupling the actuator to releasably engage the actuator from the housing to allow the bolt to extend to its second position. The bolt receives forces from contact with the sliding window when the bolt is in its second position.

According to another aspect of the invention, the actuator is carried in a recess in the bolt and is pivotally supported by the bolt within the recess.

According to a further aspect of the invention, the housing and bolt have engaging surfaces when the bolt is in its second position. The engaging surf aces include a tongue and groove arrangement wherein a tongue is located either on the bolt or the housing and a cooperating groove is located either on the housing or the bolt to absorb and transfer forces between the bolt and the housing when the stop is contacted by the sliding window.

other features and advantages of the invention will be apparent from the following specification taken in conjunction with the following drawings.

DETAILED DESCRIPTION OF THE INVENTION

Figure 1:
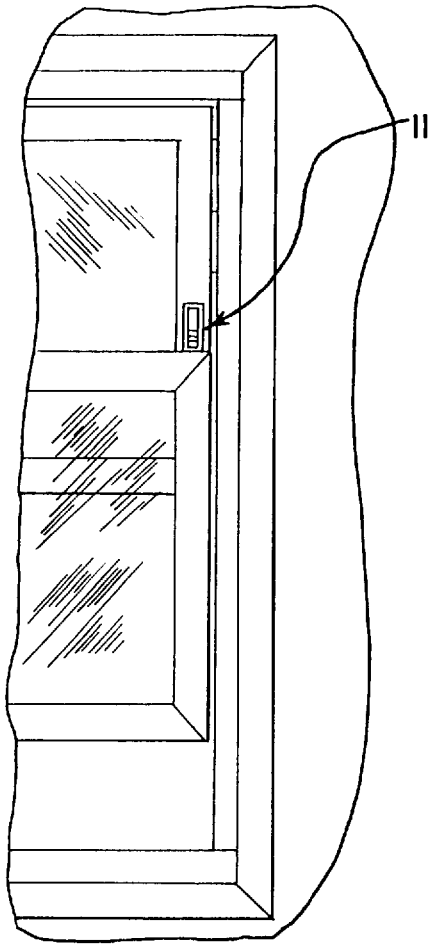
FIG. 1 PRIOR ART
FIG. 1 is a fragmentary front elevational view of a double-hung window assembly depicting a prior art window stop installed in an upper stile of a window frame.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Figure 3:
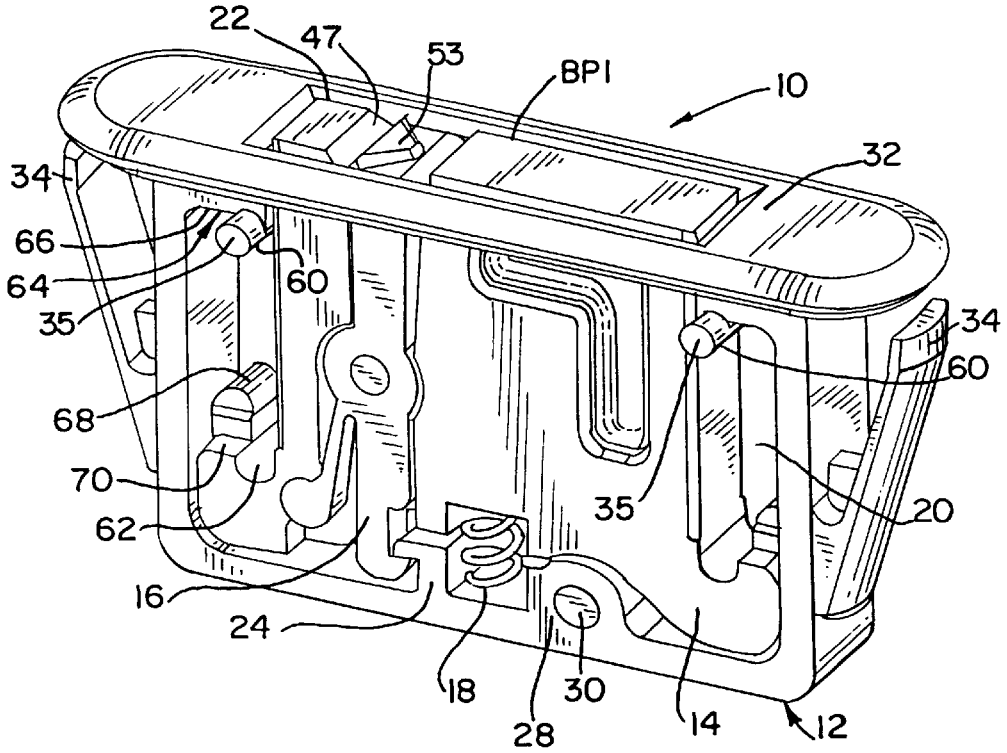
FIG. 3 is a perspective view of an embodiment of a window stop of the present invention.

Referring to the drawings, FIG. 3 shows a window stop of the present invention generally designated by the reference numeral 10. The window stop 10 generally includes a housing 12, a bolt 14, an actuator 16, and a means for biasing the bolt 18. Generally, the housing 12 is installed into a window track or sash stile of a sliding window. The bolt 12 is moveable between a first position BP1 (FIG. 3), out of the path of window movement, and a second position BP2 (FIG. 8), into the path of window movement. The actuator 16 is moveable between a first position AP1 (FIG. 4), locking the bolt 14 in its first position BP1, and a second position AP2 (FIG. 7) that allows the bolt 14 to extend to its second position BP2. The structure and assembly of the window stop 10 will first be described and then the installation and operation of the window stop 10 will be described.

Structure And Assembly

Figure 4:
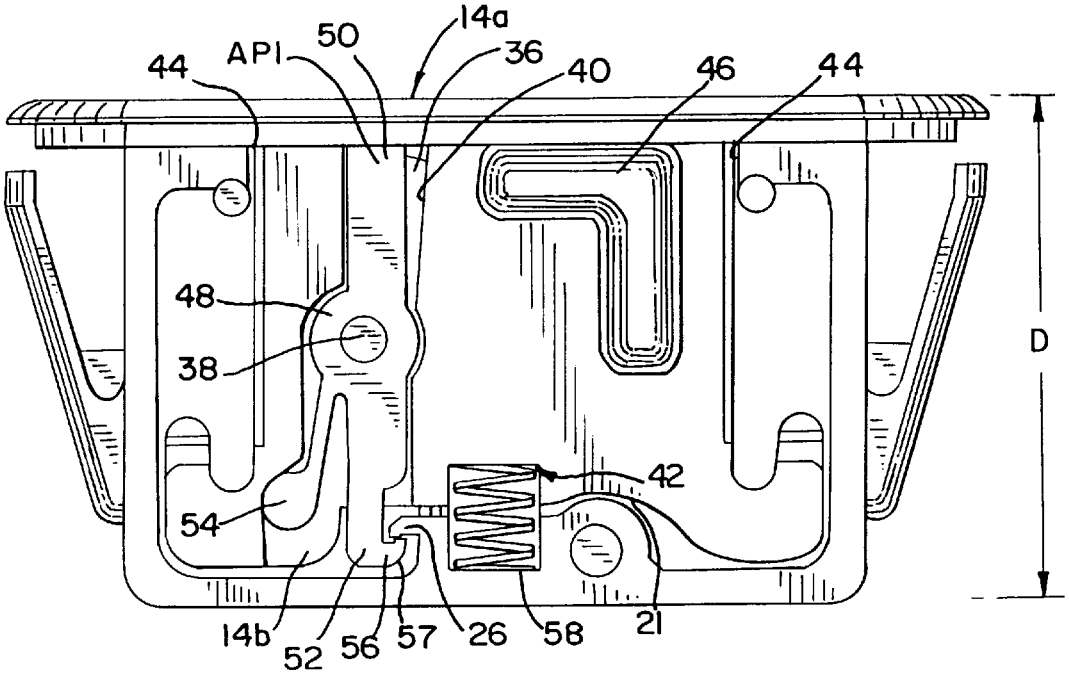
FIG. 4 is front elevational view of the window stop of FIG. 3 showing a bolt and actuator in a locked position.

As the window stop 10 is installed in either a stile or track of a sliding window, the housing 12 is advantageously narrow to allow for such installation. As shown in FIG. 3, the housing 12 has a cavity 20 that receives the bolt 14, actuator 16 and means for biasing 18. The housing 12 and cavity 20 are generally square-shaped although other configurations are possible such as rectangular. In addition, the housing 12 can be made of varying depths "D" (FIG. 4) such as when installed in window tracks or sash stiles of varying depths. At a top end, the housing 12 has an opening 22 in communication with the cavity 20. The opening 22 allows the bolt 14 to extend therethrough to its second position BP2. The housing 12 has a first projection 24 located on a bottomwall of the housing 12 that extends into the cavity 20. The first projection 24 has a pin 26 having a cam surface 27 (FIG. 4). The pin 26 cooperates with the actuator 16 to be described below. A second projection 28 is also located on a bottomwall of the housing 12, spaced from the first projection 24. A pair of ribs 29 (FIG. 8) extend along a backwall of the housing 12 from the first and second projections 24,28. The projections 24,28 and ribs 29 cooperate to assist in containing the means for biasing 18 as will be described. The housing 12 also has opposing internal surfaces 44 (FIG. 4) that guide the bolt 14 as the bolt 14 extends from its first position BP1 to its second position BP2.

Figure 5:
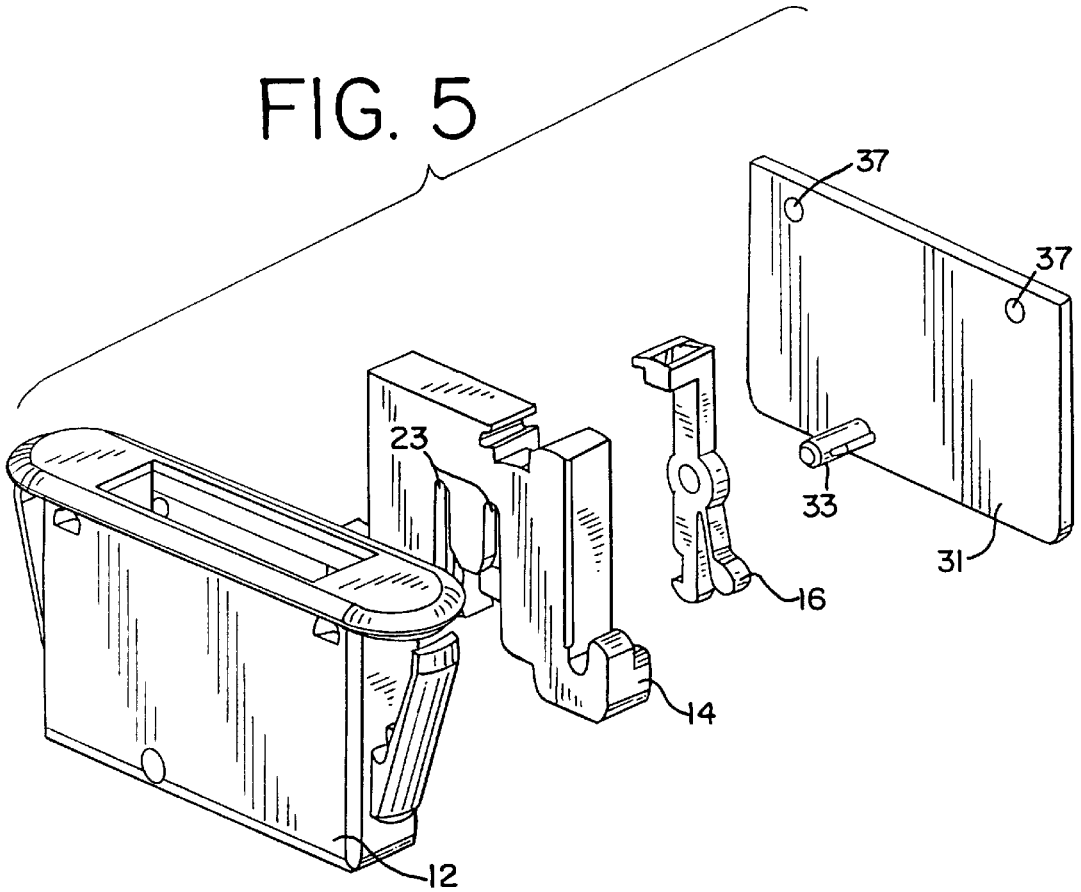
FIG. 5 is an exploded view of the window stop of FIG. 3 further including a cover plate.
Figure 6:
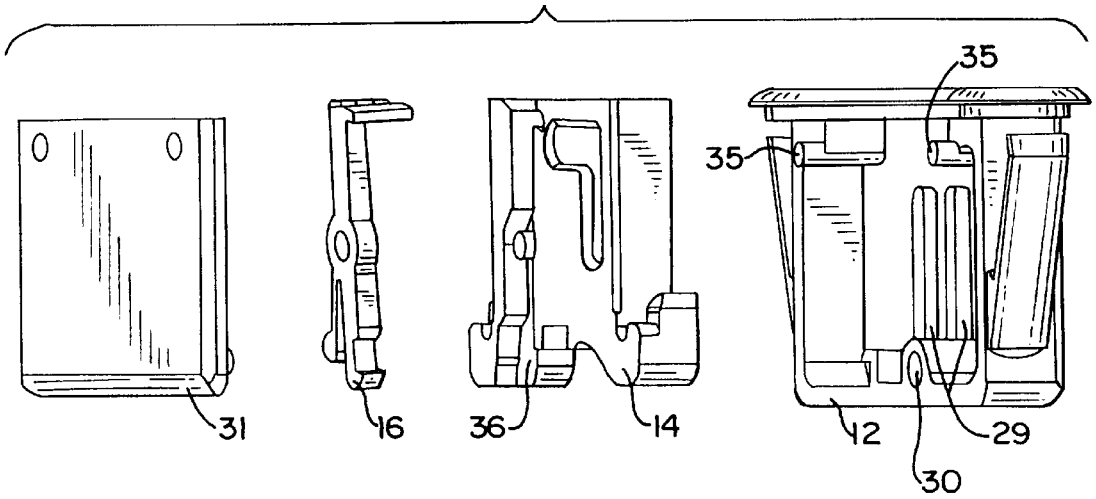
FIG. 6 is another exploded view of the window stop of FIG. 3 further including a cover plate.

As shown in FIGS. 5 and 6, the housing 12 also has a cover plate 31 that completely encloses the bolt 14 and actuator 16 in the cavity 20 of the housing 12. The cover plate 31 is not shown in FIGS. 3, 4 and 6–9 in order to show the internal structure of the window stop 10. The housing 12 has a hole 30 located in the second protrusion 28 of the housing 12 and a pair of locators 35 located on opposite sides of the housing 12 (FIG. 6). The cover plate 31 has a ribbed peg 33 and a pair of shallow indentations 37 (FIG. 5). When the cover plate 31 is joined to the remainder of the housing 12, the hole 30 receives the ribbed peg 33 in an interference fit. The locators 35 abut the indentations 37.

As further shown in FIG. 3, a faceplate 32 is included with the housing 12. The faceplate 32 is a solid member of minimal thickness and is integral with the housing 12. The faceplate 32 extends slightly forward of a track or stile of a sliding window so as not to interfere with the relative movement of the sliding window. The faceplate 32 has an opening corresponding to the opening 22 of the cavity 20 to allow the bolt 14 to extend therethrough.

To retain the housing 12 within a track or stile of a window frame, the housing 12 has a pair of integrally formed resilient clips 34 located on opposite exterior walls of the housing 12. The clips 34 extend from the exterior walls outwardly and upwardly towards the faceplate 32. The clips 34 extend to a distance slightly greater than the expected thickness of the track or stile of the sliding window.

As shown in FIG. 4, the bolt 14 is generally square-shaped and configured to fit within the cavity 20 and inside of surfaces 44 of the housing 12. The bolt 14 has a recess 36 extending into the thickness of the bolt that accommodates the actuator 16. The recess 36 extends longitudinally from a top end 14*a* of the bolt 14 to a bottom end 14*b* of the bolt 14. The recess has a bevelled surface 47 (FIG. 3) at the top end 14*a* of the bolt 14. The recess 36 also has an inclined surface 40 with a notch 41 (FIG. 7) on one side to allow the actuator 16 to pivot as will be described. A post 38 is integrally formed in the recess 36 to pivotally support the actuator 16. The bolt 14 also has a slot 42 that receives the means for biasing 18. The slot 42 can be an open slot as the means for biasing will be contained by the cover plate and a backwall of the housing 12. The slot 42, however, is preferably a closed slot. The bolt 14 has a cut-out portion 21 at its bottom end 14*b* to accommodate the projections 24,28 when the bolt 14 is in its first position BP1. As shown in FIG. 5, the bolt 14 has a pair of second cut-out portions 23 that accommodate the ribs 29 on the housing 12. The bolt 14 further may have a core 46 (FIG. 4) for injection molding purposes. The core 46 allows for sinkage of the plastic material of the bolt 14 when cooling.

Figure 7:
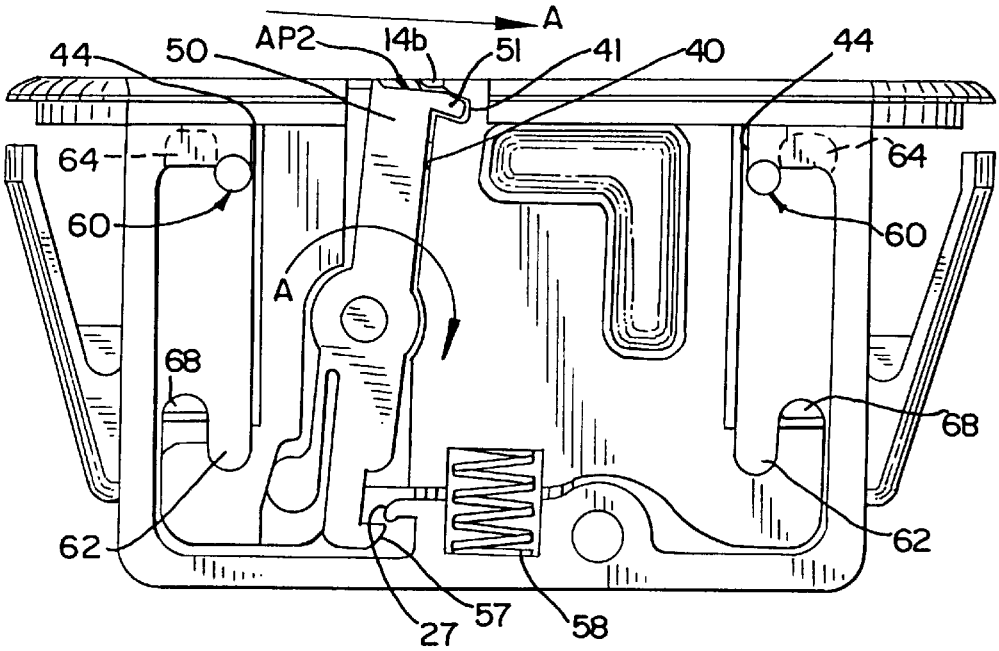
FIG. 7 is a front elevational view of the window stop of FIG. 3 showing the actuator pivoted to unlock the bolt and having a portion of a faceplate removed to show the entire actuator.

The actuator 16 is a resilient member. As shown in FIG. 3, the actuator 16 is preferably positioned within the recess 36 of the bolt 14 although the actuator 16 could be positioned at other locations in the cavity 20. As shown in FIG. 4, the actuator 16 has a central hub 48 that receives the post 38 of the bolt 14 for pivotal support. A post 50 extends from the hub 48 to the top end 14*a* of the bolt 14 at the opening 22 (FIG. 7). A finger 51 extends from the post 50. As further shown in FIG. 4, the actuator 16 has a first leg 52 and a second leg 54 extending apart from the hub 48 towards the bottom end 14*b* of the bolt 14. The first leg 52 has a latch 56 having a cam surface 57. The latch 56 is configured to cooperate with the pin 26 of the first projection 24. The second leg 54 is configured to bias the latch 56 against the pin 26 and thus bias the actuator 16 into its first position AP1. As shown in FIGS. 3 and 6, the thickness of the actuator 16 is configured to fit flush within the recess 36 of the bolt 14 so as to allow the actuator 16 to fit through the opening 22 with the bolt 14. As the actuator 16 is pivotally supported by the post 38 of the bolt 14, the actuator 16 moves with the bolt 14 between the first position BP1 and the second position BP2. This configuration allows for a smaller cavity 20 and enhances the compact size of the window stop 10. It is appreciated that the actuator 16 could be supported within the recess 36 in other non-pivotal manners to lock the bolt 14 within the housing 12.

As shown in FIG. 4, a spring 58 is positioned between the bolt 14 and the housing 12 to bias the bolt 12 to its second position BP2. Specifically, the spring 58 is positioned within the slot 42 of the bolt 14, thereby being contained within the slot 42. The spring 58 is further positioned between the projections 24,28 and ribs 29 to prevent the spring 58 from sliding along the backwall of the housing 12. Although a coil spring is shown in FIGS. 2–5, other types of springs could also be used. In addition, other types of resilient members such as those made from rubber material could be used to bias the bolt to its second position BP2.

Figure 8:
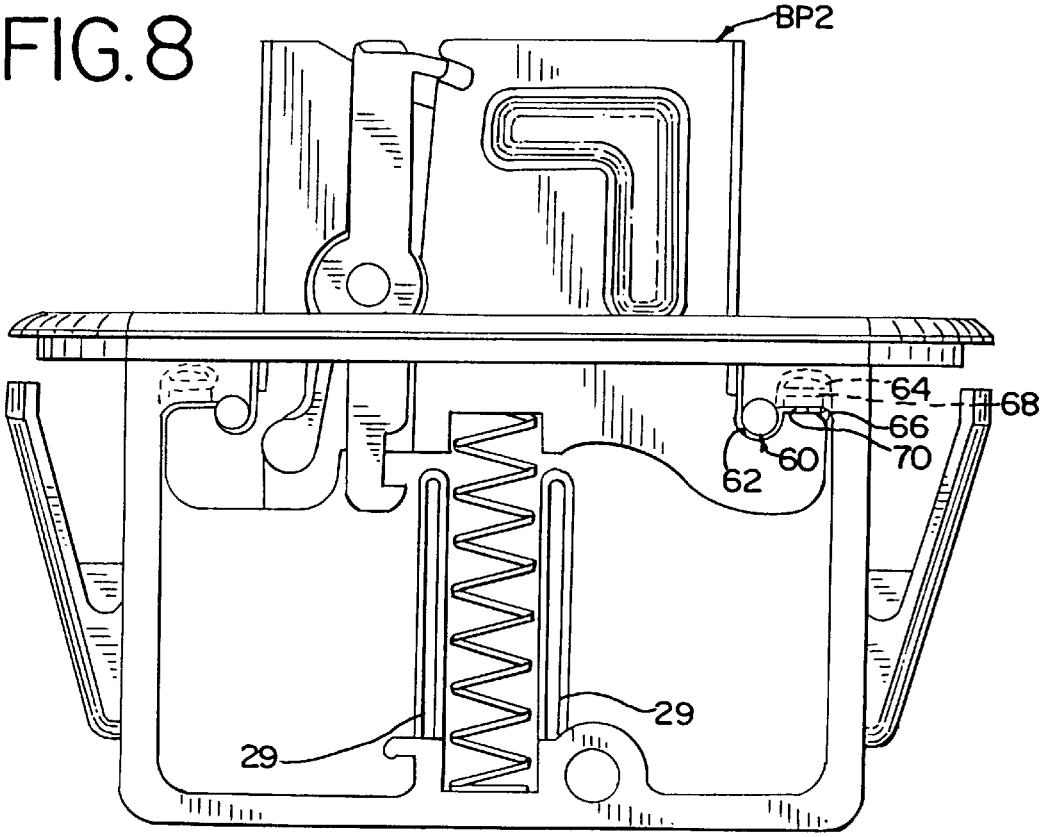
FIG. 8 is a front elevational view of the window stop of FIG. 3 showing the bolt unlocked and in an extended position; and, FIG. 9 is a perspective view of the window stop of FIG. 3 showing the bolt unlocked and in an extended position.

The housing 12 and bolt 14 have engaging surfaces in the form of a series of tongue and groove arrangements when the bolt 14 is in its second position BP2. The tongue and groove arrangements transfer forces from the bolt 14 to the housing 12 when the extended bolt (BP2) receives forces from contact with the sliding window. As shown in FIG. 7, the housing 12 has housing tongues 60 located towards opposite ends of the cavity 20. The housing tongues 60 extend downwardly from the internal surfaces 44. The locators 35, used to help position the cover plate 31 during assembly, extend outward from the housing tongues 60 (FIGS. 3, 4 and 6). The bolt 14 has bolt grooves 62 located towards opposite ends at the bottom end 14*b* of the bolt 14. As shown in FIG. 8, the housing tongues 60 are configured to cooperate with the bolt grooves 62 when the bolt 14 is extended to its second position BP2.

As further shown in FIG. 7, the housing 12 also has a pair of housing grooves 64 (openings shown in phantom) located adjacent to the housing tongues 60 towards opposite ends of the cavity 20. A lip 66 (FIG. 3) is located around a peripheral opening of the housing groove 64. The bolt 14 has bolt tongues 68 located adjacent to the bolt grooves 62 at the bottom end 14*b* of the bolt 14. The bolt tongues 68 also have recessed portions 70 (FIG. 3). As shown in FIG. 8, the housing grooves 64 are configured to cooperate with the bolt tongues 68 when the bolt 14 is extended to its second position BP2. In addition, the recessed portions 70 engage the lips 66 of the housing grooves 64.

Thus, when the bolt 14 extends to its second position BP2 (FIG. 8), housing tongues 60 cooperate with bolt grooves 62, housing grooves 64 cooperate with bolt tongues 68 and recessed portions 70 cooperate with lips 66. These engaging surfaces provide a surface area over which forces from contact with a sliding window may be transferred from the bolt 14 to the housing 12. These engaging surfaces further reinforce the stability of the window stop 10 when the bolt 14 is in its second position BP2. It is understood that a single tongue and groove arrangement could be used as well as a single arrangement on only one side of the window stop 10. It is preferred, however, that two of each pairs of engaging surfaces 60,62; 64,68 and 66,70 be used to maximize the strength and stability of the window stop 10.

In addition, the housing 12, bolt 14 and actuator 16 are all manufactured to very close tolerances. The engaging surfaces 60,62; 64,68 and 66,70 are also manufactured to very close tolerances. The parts interfit very closely to increase the already large and resistive areas over which forces may be transferred. Also, the housing 12 and bolt 14 are molded of a high strength, high impact resistant plastic material, such as polycarbonate.

To assemble the window stop 10, the actuator 16 is first positioned into the recess 36 of the bolt 14. The bolt 14 is then inserted into the opening 20 of the housing 12. The spring 58 is then positioned in the slot 42 of the bolt 14 and between the projections 24,28 and pair of ribs 29 on the housing 12. Finally, the cover plate 31 is joined to the housing 12 in an interference fit to enclose the bolt 14 and actuator 16 in the housing 12. A unitary structure is thus formed. The window stop 10 is then ready for shipment and installation into a window assembly by a window manufacturer.

Installation And Operation

Figure 2:
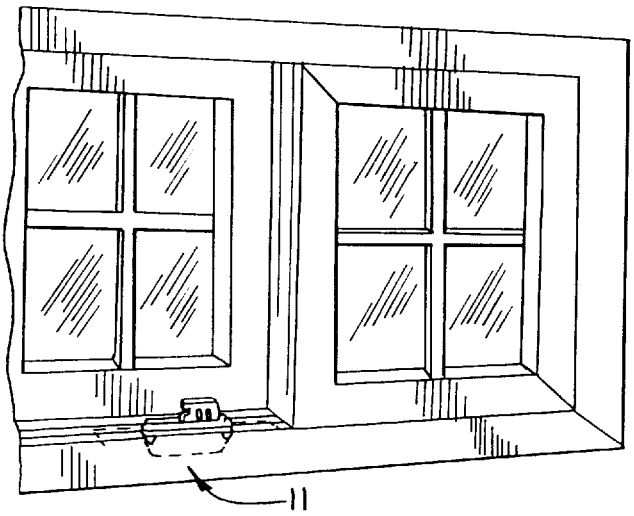
FIG. 2 PRIOR ART
FIG. 2 is a fragmentary perspective view of a sliding window assembly depicting an other prior art window stop installed in a window track of a window frame.

Although the specific installation of the window stop 10 into a window frame is not shown, it can be readily understood from FIGS. 1–9. As shown in FIGS. 1 and 2, the window stop 10 can be installed into an opening either in a stile of a window frame of a double-hung window or a window track of a horizontal sliding window. As the window stop 10 is inserted into the opening, the resilient clips 34 on the housing 12 flex inwardly to allow the housing 12 to fit into the opening. Once the clips 34 move past the opening, the clips 34 spring back underneath the relatively thin material in a hollow sash construction or against edges of a recess in a solid sash construction.

Once installed adjacent to the sliding window, the window stop 10 can be operated to limit movement of the sliding window. The window stop 10 is first configured as shown in FIGS. 3 and 4, where the bolt 14 is in its first position BP1, out of the path of sliding window movement, and preferably flush with the faceplate 32 for enhanced appearance. In this position, the actuator 16 is in its first position AP1 where the latch 56 on the actuator 16 is coupled to the pin 26 on the housing 12. In this position, the actuator 16 holds the bolt 12 in its first position BP1 against the outward bias of the spring 58.

When it is desired to limit movement of the sliding window, the actuator 16 is operated, through the opening 22, to allow the bolt to extend to its second position BP2. To this end, as shown in FIG. 7, a person manually rotates the actuator 16 clockwise, as shown by the arrows A, to its second position AP2. As shown in FIG. 3, the actuator 16 may have an arrow 53 integrally molded into the post 50 to direct the person in the direction of rotation of the actuator 16. The bevelled surface 47 on the bolt 14 (FIG. 3) assists in the person's finger easily rotating the actuator 16. As further shown in FIG. 7, the inclined surface 40 of the bolt recess 36 allows the actuator 16 to be pivoted. The notch 41 of the bolt 14 receives the finger 51 of the actuator 16 when the actuator 16 is pivoted to its second position AP2. Also, as shown in FIGS. 3 and 8, the finger 52 covers the recess 36 at the top end 14*a* of the bolt to prevent debris or other material from falling into the recess 36 through the opening 22.

Figure 9:
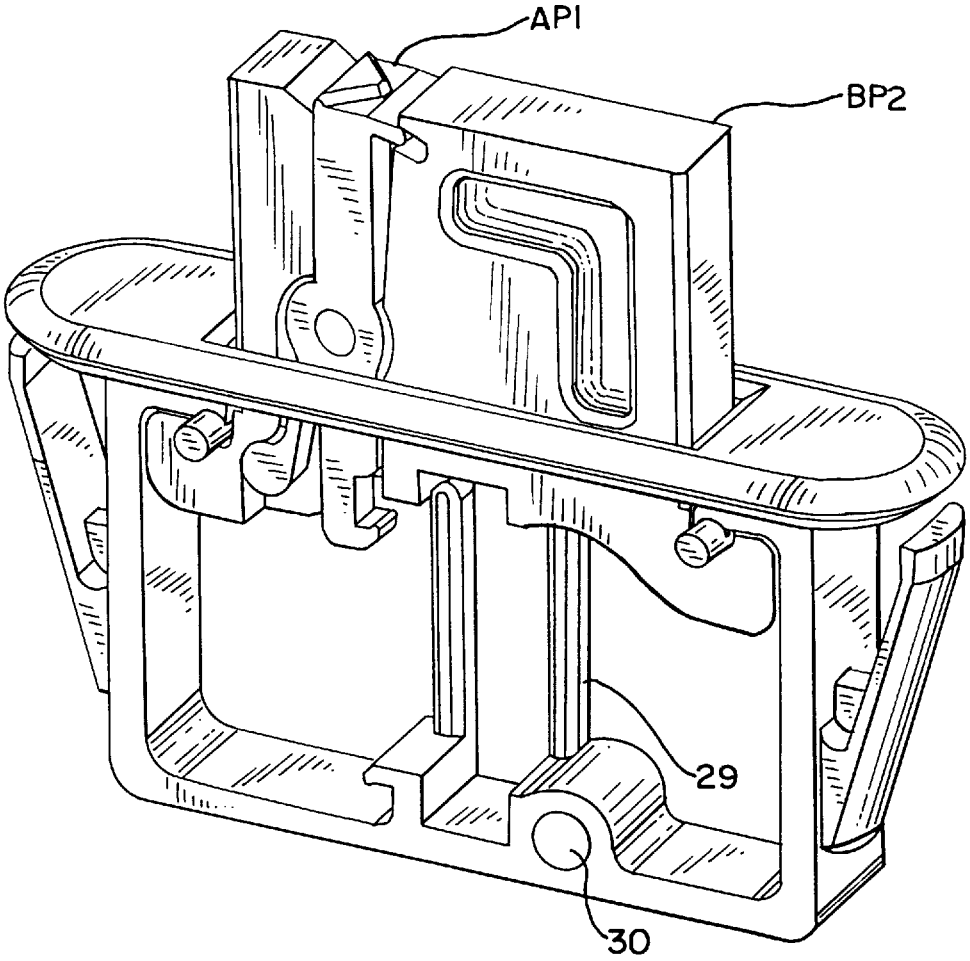

As the actuator 16 is pivoted about the hub 48 and post 36 to its second position AP2 (FIG. 7), the latch 56 disengages from the pin 26. As shown in FIGS. 8 and 9, the spring 58 then extends to immediately drive the bolt 14 out of the opening 22 to its second position BP2. Preferably, the bolt 14 has an extension of at least ½ inch from the stile or track of a window frame. In this position, the bolt 14 is in the path of sliding window movement. The resilient second leg 54 of the actuator 16 engages a wall of the recess 36 biasing the latch 16 back to its first position.

With the bolt 14 extended to its second position BP2, the housing tongues 60 extend into and engage the cooperating bolt grooves 62. The housing grooves 64 receive and engage the cooperating bolt tongues 68. In addition, the recessed portions 70 on the bolt tongues 68 engage the lips 66 at the periphery of the housing grooves 64. This construction gives the bolt 14 increased stability when in its second position BP2. When a sliding window contacts the bolt 14, sometimes at high impact, the engaging surfaces 60,62; 64,68 and 66,70 transfer the forces received from the sliding window from the bolt 14 to the housing 12. Because these engaging surfaces provide a larger resistive area over which forces may be transferred, the window stop 10 of the present invention is able to absorb higher forces from sliding windows than the conventional window lock having the rotating tumbler. In addition, the bolt 14 extends directly out of the housing along a linear axis rather than rotating out of the housing like a tumbler. Therefore, tumbler overrotation is eliminated. The bolt 14 receives the forces from the sliding window and efficiently transfers the forces to the housing via the engaging surfaces 60,62; 64,68 and 66,70.

When it is no longer desired to limit movement of the sliding window, the bolt 14 is returned to its first position BP1 by pushing the bolt back into the housing 12 through opening 22. As the bolt 14 is pushed into the housing against the outward bias of the spring 58, the cam surface 57 of the actuator latch 56 engages the cam surface 27 of the pin 26 on the first projection 24. These surfaces cooperatively engage to pivot the actuator 16 towards is second position AP2. As the bolt 14 is pushed further into the housing 12, the latch 56 passes the pin 26. The second leg 54 of the actuator 16 then biases the actuator 16 to its first position AP1 where the latch 56 engages the pin 26 and locks the bolt 14 in its first position BP1. When it is again desired to limit movement of the sliding window, the window stop is again operated as described above.

Thus, an improved window stop is provided. Because the housing 12 only requires a single cavity 20, the window stop is very compact in size. While it is not imperative that the actuator 16 be carried by the bolt 14, this configuration is preferred. With the actuator 16 carried in the recess 36 of the bolt 14, the compact size of the window stop 10 is greatly increased. The tongue and groove arrangements between the housing 12 and bolt 14 allow the window stop 10 to absorb increased forces from contact with the sliding window thereby increasing its useful life and its possible applications. Furthermore, as shown above, the window stop is easy to operate. An important application of the stop of the present invention is for limiting the movement of sliding windows. It is appreciated, however, that the stop could also be used to limit the movement of other types of sliding members, other than sliding windows.

While particular embodiments of the invention have been shown and described, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

We claim:

1. A window stop for limiting movement of a sliding window along a predetermined path of window movement, the window stop comprising:

a housing having a cavity and a top end adapted to be positioned adjacent the path of window movement;

a bolt operatively associated with the cavity and movable between a first bolt position within the housing and thereby out of the path of window movement and a second bolt position extending out of the housing into the path of window movement whereby the window is able to contact the bolt;

an actuator operatively associated with the cavity and movable between a first actuator position locking the bolt within the housing and a second actuator position allowing the bolt to extend to the second bolt position;

means for biasing the bolt towards the second bolt position; and, means disposed within the cavity for pivotally coupling the actuator to disengage the actuator from the housing at a portion of the housing spaced at a distance from the top end to allow the bolt to extend to the second bolt position.

2. The window stop of claim 1 wherein the actuator is carried by the bolt.

3. The window stop of claim 2 wherein the bolt has a recess and the actuator is pivotally supported by the bolt within the recess.

4. The window stop of claim 3 wherein the actuator has a first leg and a second leg, the first leg having a latch that cooperates with a projection located on the housing to lock the bolt within the housing, the second leg engaging a wall of the recess and adapted to bias the latch toward the projection.

5. The window stop of claim 1 wherein the actuator is operable from outside of the cavity.

6. The window stop of claim 1 wherein the bolt and housing have engaging surfaces when the bolt is in the second bolt position, the engaging surfaces comprising a tongue and groove arrangement wherein a tongue is located either on the bolt or the housing and a cooperating groove is located either on the housing or the bolt to absorb and transfer forces between the bolt and the housing.

7. The window stop of claim 6 wherein the bolt has a tongue that cooperates with a corresponding groove on the housing, the bolt further having a groove that cooperates with a corresponding tongue on the housing, wherein forces are absorbed and transferred between the bolt and the housing.

8. The window stop of claim 6 wherein the housing has a groove with a lip adjacent to the groove and the bolt has a tongue having a recessed portion, the recessed portion engaging the lip when the bolt is in the second bolt position.

9. The window stop of claim 1 wherein the means for biasing is a spring.

10. The window stop of claim 9 wherein the spring is positioned between the housing and the bolt.

11. The window stop of claim 1 wherein the housing has a relatively narrow width and a moderate depth to allow the housing to fit into a narrow track in a frame of the sliding window.

12. A window stop for limiting movement of a sliding window along a predetermined path of window movement, the window stop comprising:

a housing having a cavity and a top end adapted to be positioned adjacent the path of window movement;

a bolt operatively associated with the cavity and movable between a first bolt position within the housing and thereby out of the path of window movement and a second bolt position extending out of the housing into the path of window movement whereby the window is able to contact the bolt the bolt having a pivot;

means for biasing the bolt toward the second bolt position; and, an actuator supported by the pivot and pivotable between a first actuator position engaging the housing at a portion of the housing disposed within the cavity and spaced at a distance from the top end to lock the bolt within the housing and a second actuator position allowing the bolt to extend to the second bolt position.

13. The window stop of claim 12 wherein the bolt has a recess and the actuator is positioned within the recess.

14. The window stop of claim 13 wherein the actuator has a first leg and a second leg, the first leg having a latch that cooperates with a projection located on the housing to lock the bolt within the housing, the second leg engaging a wall of the recess and adapted to bias the latch toward the projection.

15. The window stop of claim 12 wherein the bolt and housing have engaging surfaces when the bolt is in the second bolt position, the engaging surfaces comprising a tongue and groove arrangement wherein the tongue is located either on the bolt or the housing and a cooperating groove is located either on the housing or the bolt to absorb and transfer forces between the bolt and the housing.

16. The window stop of claim 15 wherein the bolt has a tongue that cooperates with a corresponding groove on the housing, the bolt further having a groove that cooperates with a corresponding tongue on the housing, wherein forces are absorbed and transferred between the bolt and the housing.

17. The window stop of claim 15 wherein the housing has a groove with a lip adjacent to the groove and the bolt has a tongue having a recessed portion, the recessed portion engaging the lip when the bolt is in the second bolt position.

18. A window stop for limiting movement of a sliding window along a predetermined path of window movement, the window stop comprising:

a housing adapted to be positioned adjacent the path of window movement, the housing having a cavity;

a bolt operatively associated with the cavity and moveable within a first bolt position within the housing and thereby out of the path of window movement and a second bolt position extending out of the housing and into the path of window movement whereby the window is able to contact the bolt;

an actuator operatively associated with the cavity and movable between a first actuator position locking the bolt within the housing and a second actuator position allowing the bolt to extend to the second bolt position;

means for biasing the bolt to the second bolt position; and, means disposed within the cavity for pivotally coupling the actuator to disengage the actuator from the housing to allow the bolt to extend to the second bolt position, wherein the bolt and housing have engaging surfaces when the bolt is in the second bolt position, the engaging surfaces comprising a tongue and groove arrangement wherein a tongue is located either on the bolt or the housing and a cooperating groove is located either on the housing or the bolt, the engaging surfaces adapted to absorb and transfer forces from the bolt to the housing.

19. The window stop of claim 18 wherein the actuator is carried by the bolt.

20. The window stop of claim 19 wherein the bolt has a recess and the actuator is pivotally supported by the bolt within the recess.

21. The window stop of claim 20 wherein the actuator has a first leg and a second leg, the first leg having a latch that cooperates with a projection located on the housing to lock the bolt within the housing, the second leg engaging a wall of the recess and adapted to bias the latch toward the projection.

22. The window stop of claim 18 wherein the housing has a groove with a lip adjacent to the groove and the bolt has a tongue having a recessed portion, the recessed portion engaging the lip when the bolt is in the second bolt position.

23. A stop for limiting movement of a sliding member along a predetermined path of member movement, the stop comprising:

a housing having a cavity and a top end adapted to be positioned adjacent the path of member movement;

a bolt operatively associated with the cavity and movable between a first bolt position within the housing and thereby out of the path of member movement and a second bolt position extending out of the housing into the path of member movement whereby the member is able to contact the bolt;

an actuator operatively associated with the cavity and movable between a first actuator position locking the bolt within the housing and a second actuator position allowing the bolt to extend to the second bolt position;

means for biasing the bolt towards the second bolt position;

means disposed within the cavity for pivotally coupling the actuator to disengage the actuator from the housing at a portion of the housing spaced at a distance from the top end to allow the bolt to extend to the second bolt position.

24. The stop of claim 23 wherein the actuator is carried by the bolt.

25. The stop of claim 24 wherein the bolt has a recess and the actuator is pivotally supported by the bolt within the recess.

26. The stop of claim 23 wherein the bolt and housing have engaging surfaces when the bolt is in the second bolt position, the engaging surfaces comprising a tongue and groove arrangement wherein a tongue is located either on the bolt or the housing and a cooperating groove is located either on the housing or the bolt to absorb and transfer forces between the bolt and the housing.

27. A window stop for limiting movement of a sliding window along a predetermined path of window movement, the window stop comprising:

a housing adapted to be positioned out of the path of window movement, the housing having a cavity;

a bolt having a recess, the bolt movable within the cavity between a first bolt position within the housing and thereby out of the path of window movement and a second bolt position extending out of the housing into the path of window movement whereby the window is able to contact the bolt;

an actuator having a first leg and a second leg, the first leg having a latch, the actuator being pivotally supported within the recess between a first actuator position wherein the latch cooperates with a projection disposed within the cavity to lock the bolt within the housing, and a second actuator position wherein the latch is disengaged from the projection allowing the bolt to extend to the second bolt position, the second leg engaging a wall of the recess and adapted to bias the latch toward the projection;

a spring positioned between the bolt and the housing biasing the bolt toward the second bolt position; and, the bolt and housing having engaging surfaces when the bolt is in the second bolt position, the engaging surfaces comprising a tongue and groove arrangement wherein the bolt has a first groove that cooperates with a corresponding first tongue on the housing, the bolt further having a second tongue that cooperates with a corresponding second groove on the housing, the second tongue having a recessed portion that engages a lip adjacent the second groove.

* * * * *